United States Patent [19]

Schmidt et al.

[11] 4,068,122

[45] Jan. 10, 1978

[54] ISOTOPE ANALYSIS

[75] Inventors: Thomas W. Schmidt; Charles F. Cook, both of Bartlesville, Okla.

[73] Assignee: Phillips Petroleum Company, Bartlesville, Okla.

[21] Appl. No.: 713,001

[22] Filed: Aug. 9, 1976

[51] Int. Cl.[2] ..... H01J 39/34

[52] U.S. Cl. ..... 250/281; 250/288; 250/514

[58] Field of Search ..... 250/281, 288, 282, 515

[56] References Cited

U.S. PATENT DOCUMENTS

| | | | |
|---|---|---|---|
| 3,419,718 | 12/1968 | Hammond et al. | 250/251 |
| 3,801,788 | 4/1974 | Milne | 250/288 |
| 3,924,123 | 12/1975 | Schmidt | 250/251 |

*Primary Examiner*—Alfred E. Smith
*Assistant Examiner*—B. C. Anderson

[57] ABSTRACT

The difference in concentration of a selected isotope in two materials is measured by directing beams of the materials toward the inlet of a mass spectrometer. A shutter is positioned in each beam to pass the two beams at predetermined different frequencies. The output signal from the mass spectrometer is applied to two synchronous detectors, each of which receives a reference signal representative of the frequency at which a respective beam is passed to the mass spectrometer. The output signals from the two detectors are compared.

4 Claims, 4 Drawing Figures

ISOTOPE ANALYSIS

It is often desirable to measure differences in concentration of a selected isotope in two materials. Such a procedure can be employed, for example, as an aid in determining if two petroleum samples are derived from a common source. A procedure of this type is described in U.S. Pat. No. 3,649,201.

In accordance with the present invention, improved apparatus is provided which is capable of measuring the difference in concentration of a selected isotope in two materials. Beams of the two materials are directed toward the inlet of a mass spectrometer. A shutter is positioned in each beam to permit the beam to be transmitted at a predetermined frequency, the frequencies of transmission of the two beams being different. The output signal from the mass spectrometer is applied to two synchronous detectors, which can be phase sensitive amplifiers. Means are provided to establish two reference signals, each of which has a frequency corresponding to the frequency at which a respective beam is transmitted to the mass spectrometer. These two reference signals are applied to the respective synchronous detectors. The output signals from the detectors are compared, such as by the use of a differential amplifier and recorder.

In the accompanying drawing.

Figure 1:
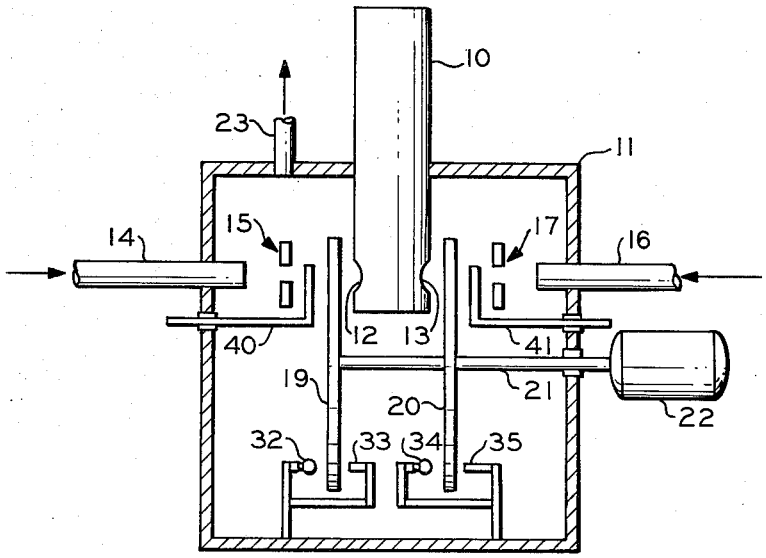
FIG. 1 is a schematic representation of an embodiment of the apparatus of this invention.

Referring now to the drawing in detail and to FIG. 1 in particular, there is shown a mass spectrometer 10, the inlet section of which is positioned within a housing 11. Mass spectrometer 10 is provided with two openings 12 and 13 which permit samples to be analyzed to be introduced into the inlet ionization chamber of the spectrometer. A first conduit 14 extends into housing 11 to deliver a first material to be analyzed. Conduit 14 is provided with suitable apertures to direct a narrow beam of the material toward inlet 12. This first beam passes through an aperture 15 in a direction toward inlet 12. A second conduit 16 extends into housing 11 to introduce a beam of a second material to be analyzed. This second beam passes through a second aperture 17 toward inlet 13. First and second disks 19 and 20 are mounted on a shaft 21 which is rotated by a motor 22. These disks are positioned in the paths of the beams from respective conduits 14 and 16. A conduit 23 extends from housing 11 to a vacuum pump, not shown, in order to maintain the interior of housing 11 at a low pressure, such as $10^{-3}$ to $10^{-7}$ Torr, for example.

Figure 2:
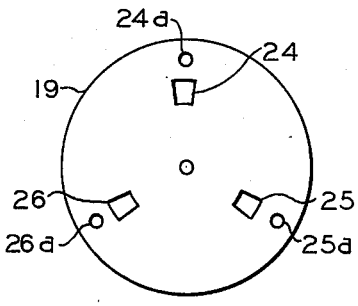
FIGS. 2 and 3 illustrate disks which are rotated in the beams of materials being compared in the apparatus of FIG. 1.
Figure 3:
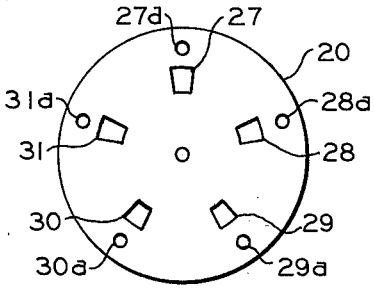

As illustrated in FIG. 2, disk 19 is provided with openings 24, 25 and 26 which are located such that the first beam directed toward inlet 12 passes through these openings as disk 19 is rotated. As illustrated in FIG. 3, disk 20 is provided with corresponding openings 27 to 31 which permit passage of the second beam directed toward inlet 13. As will be discussed hereinafter in greater detail, the two disks are provided with a different number of openings.

Disk 19 is also provided with three openings **24*a*, 25*a* and 26*a* which are positioned so as to permit passage of a beam of light from a lamp 32 to a photocell 33. In a similar fashion, disk 20 is provided with openings 27 *a* to 31*a* which permit passage of a beam of light from a lamp 34 to a photocell 35**.

Figure 4:
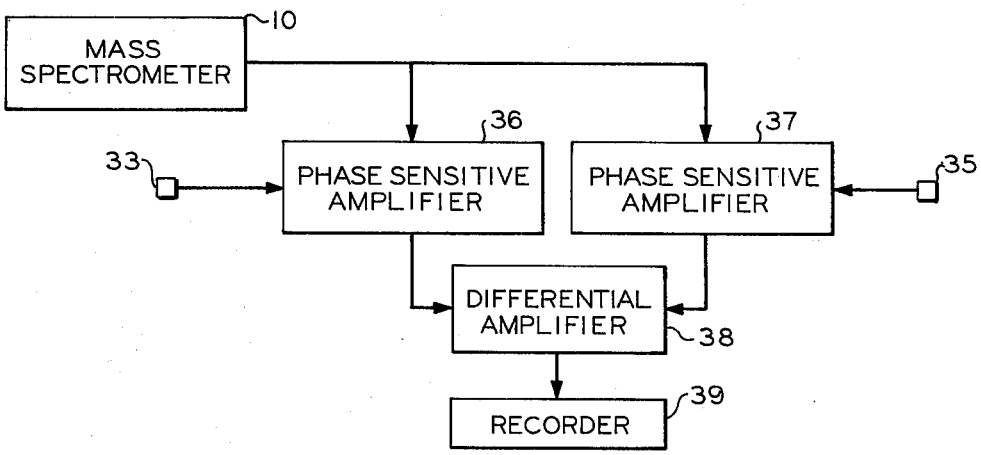
FIG. 4 is a schematic circuit drawing of the electrical components associated with the apparatus of FIG. 1.

As illustrated in FIG. 4, the output signal from mass spectrometer 10 is applied to first and second synchronous detectors which can be phase sensitive amplifiers 36 and 37. A suitable amplifier for this purpose is the Model 840 Autoloc Amplifier described in *Keithley Engineering Notes,* volume 19, No. 1, of Keithley Instruments, 28775 Auroro Road, Cleveland, Ohio 44139. Electrical signals derived from photocells 33 and 35 are also applied to respective phase sensitive amplifiers 36 and 37. The output signals from these two amplifiers are applied to the inputs of a differential amplifier 38. The output of amplifier 38 is applied to a recorder 39.

In one method of operation of this invention, a stream of a first gas to be analyzed is introduced through conduit 14. A sample of a reference gas, which has a composition closely approximating the first material, is introduced through conduit 16. Motor 22 is actuated to rotate disks 19 and 29 at a predetermined rate. Mass spectrometer 10 is set to measure a given mass number of a constituent of the two gases. In the method described in U.S. Pat. No. 3,649,201, for example, the ratio of carbon-13 to carbon-12 is measured in two carbon dioxide samples. In such a measurement, mass spectrometer is first set to measure mass 44, a representative of carbon-12. The apparatus is then adjusted so that the output signals from amplifiers 36 and 37 have the same amplitude. This adjustment can be made by manipulation of one or both of trimming devices 40 and 41 of FIG. 1 which can be rotated into and out of the respective beams to reduce or increase the magnitude of the beam reaching the inlet of the mass spectrometer. After this initial adjustment has been made, mass spectrometer 10 is set to measure a different mass number, such as 45 which is representative of carbon-13. The resulting output signal applied to recorder 39 can be utilized to measure the isotope ratio of carbon-13 in the two samples. The isotope ratio difference can readily be calculated by dividing the difference signal applied to recorder 39 by the output signal from detector 36 alone. To this end, recorder 39 can be a multi-channel recorder which also records the output signal from detector 39. As an alternative, a signal dividing circuit can be provided to divide the difference signal from the two detectors by the signal from detector 36 alone. The signals can be utilized in the manner described in U.S. Pat. No. 3,649,201, for example.

As previously mentioned, the two beams are delivered to the inlet of the mass spectrometer at different frequencies. This is readily accomplished by mounting the two chopping disks on a common shaft, and providing a different number of openings in the two disks. As an alternative, two disks with the same number of openings can be rotated in the respective beams at different rates. If the two beams are directed toward the inlet of the mass spectrometer from adjacent sources at a converging angle, a single disk with two sets of openings can be employed. In this case, one beam passes through one set of openings and the second beam passes through the second set of openings.

In another specific embodiment of this invention, the mass-3 to mass-2 ratio of a hydrogen sample is measured using apparatus of the type illustrated in the drawing. A typical composition of the reference hydrogen sample is 99.8 percent mass-2 and 0.2 percent mass-3. The sample to be analyzed may have a composition of 99.9 percent mass-2 and 0.1 percent mass-3. Disks 19 and 20 are rotated at 50 Hz. Mass spectrometer 10 first measures mass-2 for some 5 to 10 minutes, after which mass-3 is measured for some 2 to 15 minutes.

While this invention has been described in conjunction with presently preferred embodiments, it obviously is not limited thereto.

What is claimed is:

1. Analysis apparatus comprising:

a mass spectrometer having an inlet adapted to receive samples of materials to be analyzed, said mass spectrometer being adapted to provide output signals representative of selected masses of constituents of samples supplied to said inlet;

means to direct a first beam of a first sample material toward said inlet;

means to direct a second beam of a second sample material toward said inlet;

first shtter means positioned in said first beam to pass said first beam to said inlet at a first predetermined frequency;

second shutter means positioned in said second beam to pass said second beam to said inlet at a second predetermined frequency which is different from said first frequency;

first and second phase sensitive detectors;

means to apply reference signals to said first and second detectors representative of passage of said first and second beams, respectively, to said inlet;

means to apply the output signal from said mass spectrometer to said first and second detectors; and means to compare the output signals from said detectors.

2. The apparatus of claim 1 wherein said first shutter means comprises a first disk adapted to be rotated in the first beam, said first disk having a plurality of first openings therein to permit passage of the first beam as the first disk is rotated, and said second shutter means comprises a second disk adapted to be rotated in the second beam, said second disk having a plurality of second openings therein to permit passage of the second beam as the second disk is rotated.

3. The apparatus of claim 2, including means to rotate said first and second disks at a predetermined rate, and wherein the number of openings in said second disk is different from the number of openings in said first disk.

4. The apparatus of claim 2 wherein said means to apply reference signals to said detectors comprises a first light source and a first light detector positioned on opposite sides of said first disk and a second light source and a second light detector positioned on opposite sides of said second disk, said first and second disks being provided a plurality of third and fourth openings, respectively, to permit passage of light from the sources to the respective light detectors as the disks are rotated, there being the same number of first and third openings in said first disk and the same number of second and fourth openings in said second disk.

* * * * *